US011348389B1

(12) United States Patent
Kushnir

(10) Patent No.: US 11,348,389 B1
(45) Date of Patent: May 31, 2022

(54) LOCK AND SWITCH CONTROLLER DEVICE WITH OFFLINE RESPONSIVENESS TO FLEXIBLE COMMANDS

(71) Applicant: Marat Kushnir, Thornhill (CA)

(72) Inventor: Marat Kushnir, Thornhill (CA)

( * ) Notice: Subject to any disclaimer, the term of this patent is extended or adjusted under 35 U.S.C. 154(b) by 0 days.

(21) Appl. No.: 17/321,942

(22) Filed: May 17, 2021

(51) Int. Cl.
*G07C 9/00* (2020.01)

(52) U.S. Cl.
CPC . *G07C 9/00309* (2013.01); *G07C 2009/0038* (2013.01); *G07C 2009/00396* (2013.01)

(58) Field of Classification Search
None
See application file for complete search history.

(56) References Cited

U.S. PATENT DOCUMENTS 9,858,739 B1 * 1/2018 Johnson ..... G07C 9/00309
9,940,828 B2 * 4/2018 Hou ..... G08C 17/02
2002/0198625 A1 * 12/2002 Paashuis ..... G07F 7/025 700/241
2005/0236905 A1 * 10/2005 Tsai ..... G07C 9/00182 340/13.24
2007/0289962 A1 * 12/2007 Kruempelmann .. F24C 15/2014 219/490
2012/0313744 A1 * 12/2012 Vuyst ..... H04L 12/2818 340/4.3
2014/0129006 A1 * 5/2014 Chen ..... G05B 15/02 700/90
2016/0232726 A1 * 8/2016 Zizi ..... G06F 21/32
2017/0105248 A1 * 4/2017 Dolinski ..... H05B 1/0266

* cited by examiner

*Primary Examiner* — Carlos Garcia

(57) ABSTRACT

The present invention provides a control system that can be used to control switches and locks with a view to providing controlled access to target devices. The control system comprises a code-generating process that can generate commands or instructions to a target device which are encrypted. The commands can be presented as a numeric token and delivered to a customer, who can manually input the token into a controller of an access unit, containing a lock or a switch, which in turn manages access and functionality of a target device or appliance. A control system allows a lock or switch to operate independently based on internally programmed algorithms within a controller without any wireless communication.

14 Claims, 5 Drawing Sheets

LOCK AND SWITCH CONTROLLER DEVICE WITH OFFLINE RESPONSIVENESS TO FLEXIBLE COMMANDS

FIELD OF THE INVENTION

The present invention relates generally to an electronic system. More particularly, the present invention relates to an electronic system that allows an owner or administrator to remotely control a lock or other access-controlling switch or actuator mounted on an appliance without any communication network. The present invention allows for remote operational or access control to premises, lockers, safes, equipment, or any other target device with such device being offline and not connected to any communication network.

BACKGROUND OF THE INVENTION

A lock is generally a mechanical fastening device that is usually locked or released by a physical object such as a key or token. A lock can also be locked or released using key codes or other numeric combinations. With the addition of an electronic circuit, a lock can also be released using a keycard, fingerprint, RFID card, or passcode, such as a permutation of numbers or letters. Online connectivity and other communication methods (e.g., Wi-Fi, RF, Bluetooth, GPRS, IoT) enable locks to be operated using mobile phones or the Internet in such ways as to not only fasten or release a lock but also provide remote access control and management.

A switch removes or restores the conducting path in a circuit. The most common switch is a manually operated electromechanical device with one or more sets of electrical contacts that are connected to external circuits.

A switch as an electromechanical toggle or push-button device can also take the form of a key, which may not only open or close a device, thereby changing the device's electrical state from off to on (or vice versa), but also change a device's status from being idle and irresponsive to being responsive to a user's commands.

The present invention refers particularly to the ability to control and manipulate an appliance, whilst such appliance is offline and not connected to any wide area communication, by users who are not the administrators of such appliance without compromising any security and without the administrator being physically present in the proximity of the particular appliance.

Every type of lock operation has its shortcomings or limitations. These limitations are also common in controlling access for many switch mechanisms. Such operational limitations can be related to: duplication, loss, time, compromise, rigidity, stagnation, visibility, locality, gadget or connectivity.

A key can usually be duplicated and if lost compromises the security of an asset requiring replacement of the keyway barrel or in some cases the entire lock.

The passage of time increases risk as more people had possession of the key or the numeric combination.

There are classical options of using a master key where a single key can conveniently open multiple locks. This is advantageous in scenarios where an administrators don't have to carry a large number of keys corresponding to each lock. For example, a cash collector for vending machines has a single key that opens many locks. However, the risk of loss or duplication of this master key amplifies all known problems since compromising the master key endangers all the locks served by this key.

The inability to change a lock's configuration in a flexible manner results in operational rigidity and ineffectiveness. Mechanical or Electronic locks which are operated by using a passcode are typically subject to stagnation of the passcode. Someone who is entitled to use of the premises for one night, will be able to use the passcode indefinitely until such time as the owner changes the passcode. A fixed arrangement of numbers or letters as a passcode allows for easy memorization of the lock sequence by frequent visibility. Similarly, the numbers in the combination may be deduced by which keys show the most wear and tear signs of constant use. The ability to change a passcode typically requires the administrator to be physically present at the same locality to reprogram the lock.

Certain locks require a special gadget for key programming and management, for example, RF or magnetic locks typically found in hotels require special hardware to program the keys. Hence reception personnel must be available at all times day or night at the service desk with its respective gadget to reprogram the key.

Some locks or switches can be manipulated wirelessly or by other electronic means requiring broad connectivity. The lock itself must have connectivity to a communication network (e.g. WiFi, LAN, WAN, GPRS, Cellular) and can be controlled via a remote command (over the internet) or a local command using an application on a mobile phone using Bluetooth, RF, WiFi or other short range communication method. Wide area connectivity is not always available in all geographic areas and large number of frequently changing users makes using mobile applications unpractical.

The present invention reduces or eliminates the limitations of existing locks or switches as far as duplication, loss, time, compromise, rigidity, stagnation, visibility, locality, gadget and connectivity are concerned. The invention addresses problems associated with conventional systems and devices through an innovative control system that is designed to provide a convenient and effective means of controlling switches or locks while incorporating other problem-solving features.

SUMMARY

Embodiments of the present invention address deficiencies of the art in respect to controlling and manipulating accessibility and provide a novel and nonobvious method and system for controlling switches and locks so as to provide controlled access to target devices or appliances.

The present invention uses the sequence of symbols (which can be in human readable form) as an encrypted means, or "coded language," for controlling or programming a lock or a switch device ("Access Unit"). Hence (a) the present invention may contain numerous functions associated with a user's code (e.g., setting access limits, user types, or operational and other programming functions), (b) functions and facilities may be constrained to different durations with a variety of consequences, and (c) the function of the code or its intended instruction, for a target device, is independent and indistinguishable whether such instruction is executed by an owner of a target device or by a guest user.

The present invention differs from other existing lock and switch mechanisms where typically: (a) A single function is associated with a user's code ('open' or 'on'); (b) the function is unidirectional ('open only' or 'on only') or a toggle between subsequent entries ('on/off/on . . . '); (c) the function of the user's code is distinct to the user and any other reconfiguration of a lock or switch has to be done by the owner or administrator themselves.

In the present invention the owner or administrator does not have to do any new reconfiguration for a new or existing user themselves, rather the user by inputting an encrypted code (issued by the owner or administrator) reprograms covertly the lock or switch i.e. access unit, in accordance with newly desired parameters (for itself as a user or any other desired function). Using a specially encrypted token allows any guest or user to be the 'programming or encoding messenger' delivering an intended function (issued by an owner of an appliance) without compromising any security and without such target device being connected to a communication network.

The present invention provides instructions for an access unit that are embedded and encrypted within a readable numeric or alphanumeric token. Decryption of the token by the controller in the access unit provides offline control of a target device. The controller, access unit or target device are not required to be connected to the Internet or any other communication network. The entire control logic resides inside the controller, with instructions delivered through the manual input of a numeric encrypted token into a keypad. Appliances or target devices can thus be remotely controlled without the need for connectivity of such appliances to a Wi-Fi, cellular, or any other communication network.

An owner or administrator does not have to perform any new reconfiguration for a user. When the user by inputs an encrypted code issued by the owner or administrator, the control system of the present invention can reprogram the lock in accordance with newly desired parameters.

In one embodiment, using a specially encrypted token, the present invention allows any guest or user to act as "programming or encoding messenger" delivering to the controller an intended function issued by an owner or administrator without compromising any security and even without the access unit or its controller being connected to a communication network.

In one aspect, the controller allows for access control for a variety of user categories, to a myriad of appliances, at specified frequencies and durations. In another aspect, an administrator can allow or restrict users access to certain appliance functionality based on their credentials. Furthermore, an owner or administrator achieves its desired configuration without being in the vicinity of the target device despite such target device not being connected to the internet or any other communication network.

DETAIL DESCRIPTIONS OF THE INVENTION

Figure 1:
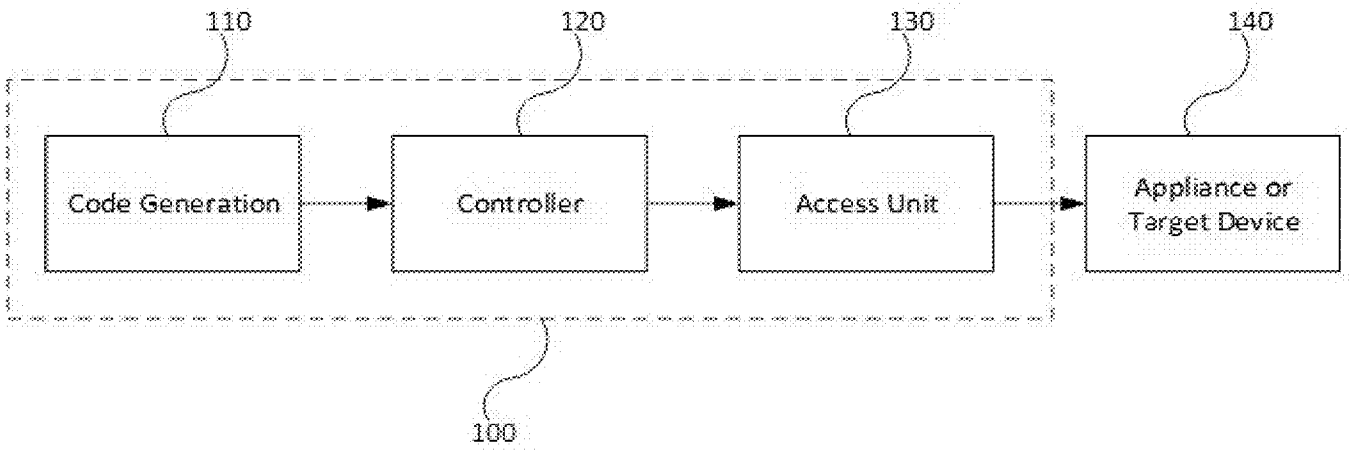
FIG. 1 is an illustration of one embodiment of the present invention.

All illustrations of the drawings are for the purpose of describing selected versions of the present invention and are not intended to limit the scope of the present invention.

The present invention provides expanded functionality to a lock or a switch mounted on an appliance or any target device that needs to be monitored. The present invention also provides an alternative control of a lock or a switch by its owner or administrator enabling or restricting certain functionality access to other person (who can be a customer of the owner or administrator) based on their credentials.

The present invention can also be retrofitted or alternatively fitted on top of or in addition to existing locks or switches that are capable of receiving an electrical signal to change their state, such as from open to closed or from on to off (or vice versa).

The present invention reduces or eliminates various limitations of existing locks or switches. For example, the present invention eliminates typical security shortcomings associated with access control, such as those associated with duplication (absence of physical keys prevents unauthorized duplication), loss (absence of physical keys prevents such from being lost or stolen), and time (keys are virtual, with new combinations instantly generable).

The present invention eliminates the issues associated with compromise of master keys, which are commonly used in industrial settings. Master keys, or indeed any keys, can be regenerated and configured whenever required.

The present invention avoids any rigidity associated with changing a lock or switch configuration without that lock or switch being present, without the need for a communication network.

The present invention also bypasses issues associated with combination locks whereby the same code is shared among a group of people or when changing a code requires on-site reconfiguration of the lock.

The present invention solves common practical problems relating to scalability, where access control to numerous facilities in confined spaces is required (e.g., multiple containers, many doors or lockers, myriad equipment). The present invention also solves issues related to rural or other installations for which wireless communication is not desired or is not available.

The present invention encompasses the following main elements, namely: Code Generation; Controller; Access Unit; and Appliance.

Code Generation, refers to an external software application which generates a code to be inputted into the controller. The code is encrypted and is used to issue commands or other programming functions for the controller. The code can be in human readable format (e.g. for manual inputting into the controller's keypad) or in other formats accepted by a given controller (e.g. QR code, barcode, sound tone, etc).

Controller, refers to the electronic circuitry containing a microcontroller connected with an access unit. The controller contains the decryption key and logic with a myriad of commands and reprograming logic used for particular access units and appliances.

Access Unit, is the immediate device which is regulated by the controller. Typically, such device is a lock or a switch which allows functional access to an appliance. Unless indicated otherwise, referring to the access unit typically includes an integrated controller.

Appliance, refers to the equipment which is being controlled or a target device. Appliances may include: latch locks, deadbolt locks, pad locks, safety boxes, machinery, equipment, vehicles etc.

As FIG. 1 shows, the present invention includes a control system 100 that comprises a plurality of processors and a plurality of memories, with the latter containing instructions that when executed by a processor trigger a code generation 110. The instructions may include routines, programs, objects, data structures, and the like.

The control system 100 includes a controller 120 that is configured to receive and interpret data generated from the code generation 110. The generated code (data) is encrypted and presented in human readable format (e.g., numeric token) and can be transferred to any user verbally, by text, paper receipt or email. The controller 120 can accept the code in person through the manual input into a keypad.

The present invention allows any person including a customer, who receives the data from the code generation 110 by the administrator or the owner of the present invention, to gain access to an appliance or furthermore to reprogram the controller without compromising any security.

In some embodiments, the controller 120 may be equipped with peripherals such as a camera, microphone, scanner, Bluetooth or other wireless connectivity. In this embodiment an administrator or owner of the present invention can transfer the encrypted code, image, URL or file by email or through an application. A customer who receives such code format can use his smart phone or tablet or any portable terminal, with appropriately corresponding features, to transfer the code to the controller using an alternative transfer method.

The code generation 110 of the present disclosure may be implemented in the form of a software application running on a computer system (for example, a mainframe, personal computer (PC), server, etc.). The software application may be stored on a storage media locally accessible by the control system 100, for example, floppy disk, compact disk, hard disk, etc., or may be accessed remotely by the computing device, for example, via a wired or wireless network, such as a local area network, a wide area network, the Internet, etc. The computer system may also be a laptop computer, a cellular phone, a personal digital assistant (PDA), a tablet computer, and other mobile devices of the type.

The code generation 110 may include any code-generating method known in the art and provide data to be transferred to the controller 120, wherein the data can include one or more command parameters that can be used by the controller 120 to control an access unit 130 (further included in the control system 100) attached to a target device or appliance 140 that is to be monitored and whose use is to be controlled.

Once the controller 120 has deciphered the inputted instructions it would function in accordance with predefined routines or operations. Such operations may be general programming instructions or specific routines or restrictions for a particular user and/or a particular appliance 140 which are executed by the controller 120 via the access unit 130 connected to the appliance 140.

Figure 2:
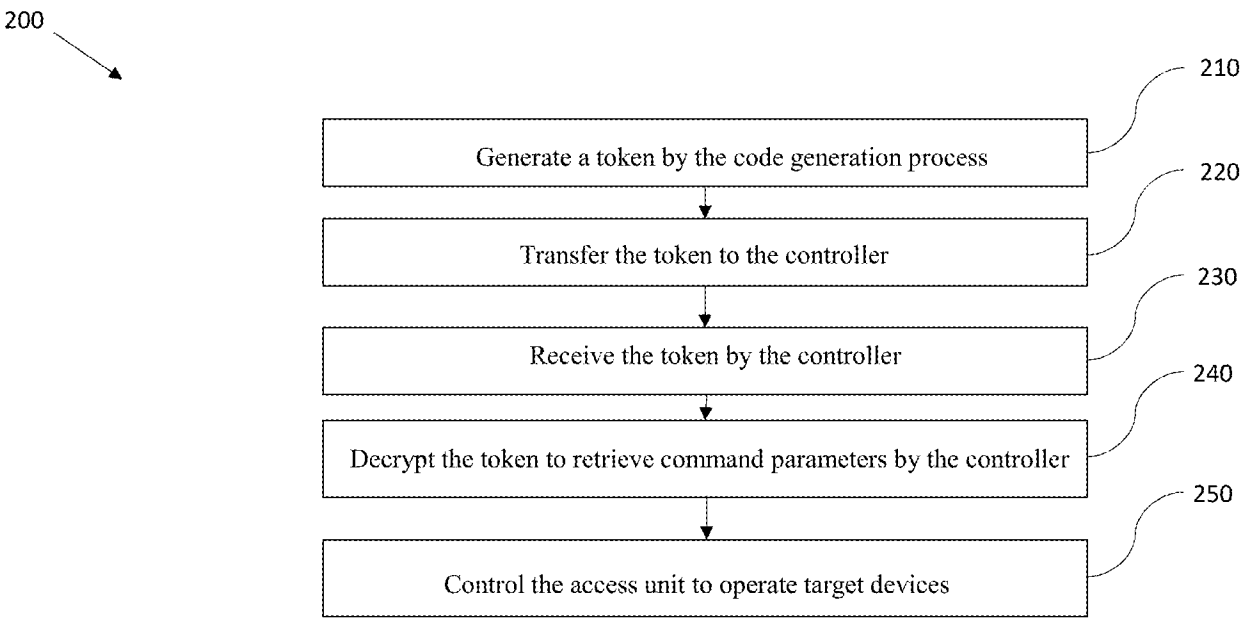
FIG. 2 is a diagram illustrating a process of the present invention that controls the target device or appliance.

FIG. 2 is a flow diagram of a process 200 for controlling a target device or appliance 140 according to one embodiment of the present invention.

At block 210, the command parameters in the form of a token can be generated by the code generation 110 and transferred to the controller 120 at block 220.

At block 230, the controller 120 receives the token which may provide functional instructions for the controller 120 and the access unit 130. The controller 120 refers to electronic circuitry containing a microcontroller. The controller 120 contains a decryption key and logic algorithms, with a list of commands and programming logic for one or more target devices or appliances 140.

At block 240, the controller 120 decrypts the token retrieving the assigned instructions and command parameters and at block 250, the controller 120 acts upon the access unit 130 to operationally manipulate a target devices or appliance 140 according to the functional instructions included in the command parameters.

The access unit 130 is regulated by the controller 120 and includes a switch or lock or any other device that allows functional control of the target device or appliance 140.

The target device or appliance 140 is equipped with an access unit 130 and controller 120 allowing the control of such target device by manipulation of a lock or switch for attaining the desired functionality. The target device or appliance 140 may include latch locks, deadbolt locks, pad locks, safety boxes, machinery, equipment, vehicles, and so forth.

Figure 3:
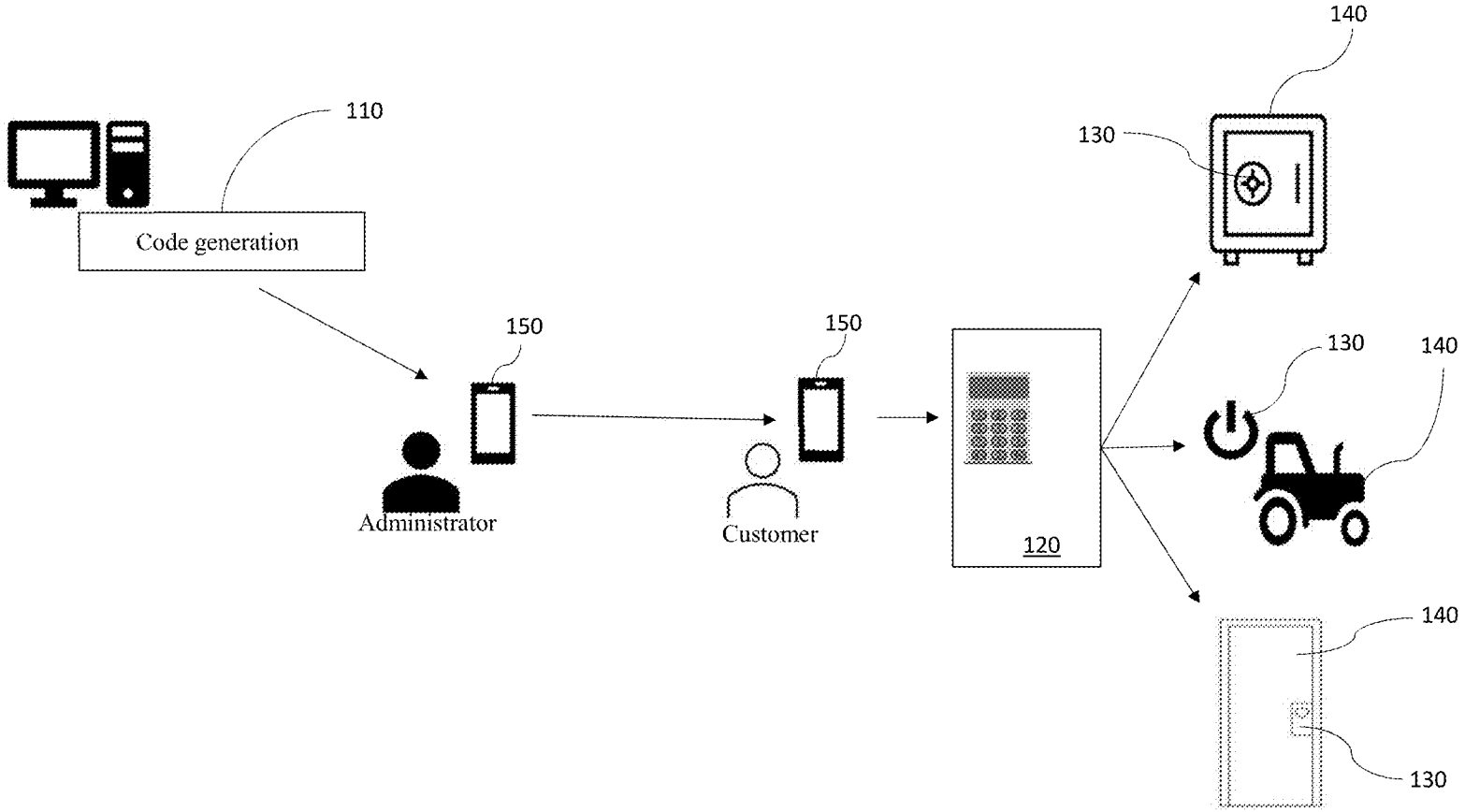
FIG. 3 is an illustration of one embodiment of the present invention with an administrator and a customer.

In one embodiment, as shown in FIG. 3, the token generated by the code generation 110 can be transferred to a computing device 150 of an administrator (or owner) and further transferred to a computing device 150 of a customer. The customer can manually, or via other mechanisms supported by the computing device corresponding with the controller, input the token into the controller 120 which may be connected to one or more access units 130 (attached and connected to particular target devices or appliances 140). The computing device 150 of an administrator and the customer may also be a laptop computer, a cellular phone, a personal digital assistant (PDA), a tablet computer, and other mobile devices of the type.

In some other embodiment, the present invention may include an input method that can be the simple entry of a numeric token into a keypad provided on the target devices or appliances 140 (within which the controller 120 and the access unit 130 are integrated). Alternatively, the input method into the target devices or appliances 140 may also occur via Bluetooth, RFID, QR code, barcode, sound tone, or any other short-range communication typical to a mobile phone.

Figure 4:
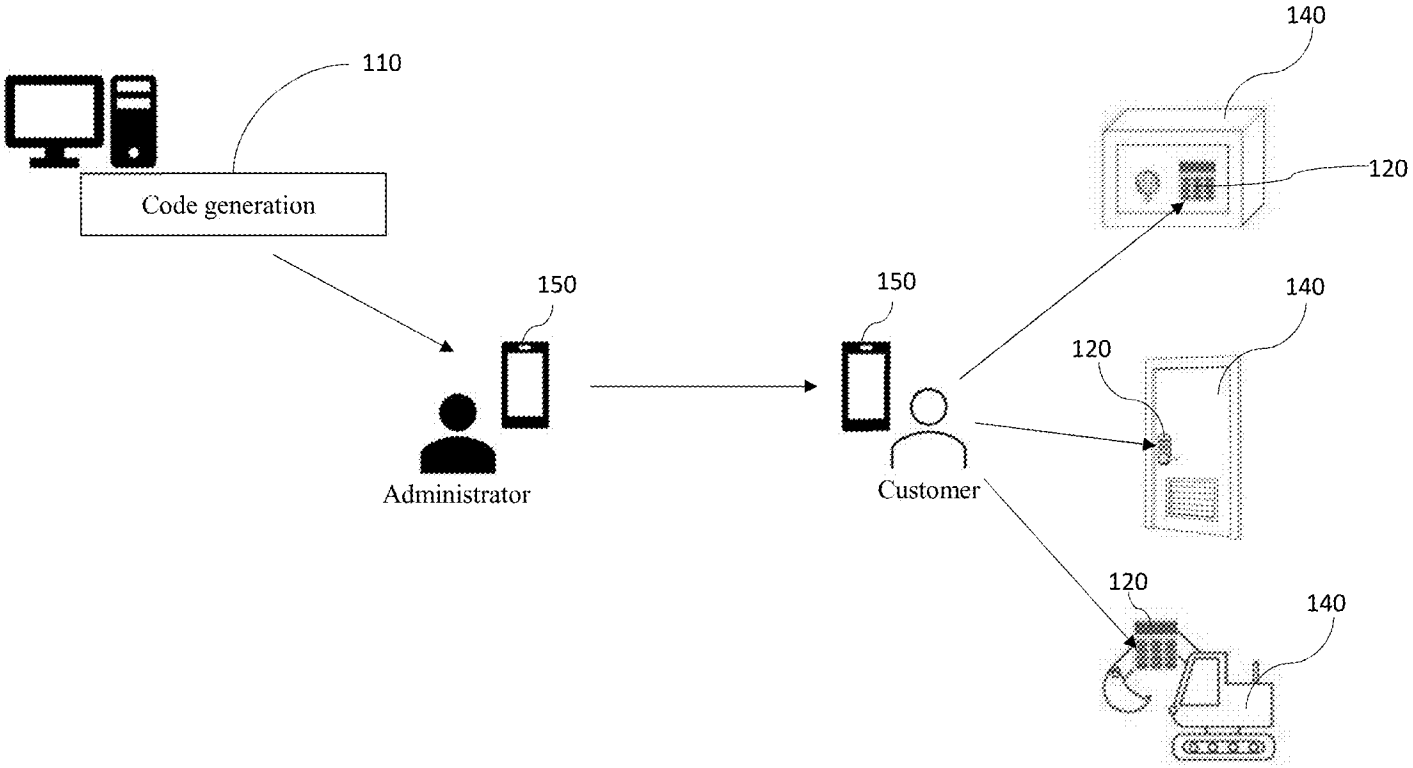
FIG. 4 is an illustration of one embodiment of the present invention with an administrator and a customer to control target devices via access units integrated with a controller.

In preferred embodiments, the controller 120 is integrated with the access unit 130 and attached to the target device or appliance 140, as shown in FIG. 4.

Command parameters are included within an encrypted token and provide instructions for the controller 120. The following is an illustration of a variety of command parameters that can be encrypted within a token.

The command parameter can include a plurality of references. In one embodiment, the command parameter can include A-O references, each having a different parameter: A for command type, B for serial number, C for user category, D for access type, E for access count, F for allow access before check-in time, G for check-in date/time, H for check-out date/time, I for duration, J for passcode options, K for personal passcode, L for override options, M for failed entry rules, N for consequence of failed entries, and O to set the consequence at expiry.

The A reference can be used to (1) allow access until a given date/time, (2) allow access for a given duration (minutes/hours/days), (3) erase access for existing respective user types, (4) reset tamper state, (5) set clock date/time, and (6) change decoding key.

The B reference can be used to match the number of the access unit or target device.

The C reference can be used to identify (1) owner, (2) administrator, (3) supervisor, (4) employee, (5) technical, and (6) guest.

The D reference can be used to (1) allow once only, (2) allow multiple, or (3) allow a limited count.

The E reference can be used for the number of times a user is allowed to gain access for a given duration.

The F reference can be used to give access (1) before check-in time or (2) after check-in time.

The G reference can be used for date/time of commencement (i.e., to grant access).

The H reference can be used for expiry date/time of access.

The I reference can be used for specific time duration to allow access.

The J reference can be used to (1) allow the user to select, (2) prescribe for the user, or (3) not allow.

The K reference can be used for a short passcode that (if prescribed for the user) may be used subsequently to gain access.

The L reference can be used for an indicator signaling that prior users (of the same category) will be denied access. Hence this signal invalidates previous users.

The M reference can be used to indicate how many failed passcode entries are allowed before entering blackout.

The N reference can be used for (0) none (do not allow access), (1) blackout for specified time in minutes, (2) sound alarm, (3) close contactor, (4) open contactor, or (5) initiate communication.

The O reference can be used for (0) none (do not allow future access), (1) close contactor (initiate auxiliary circuitry), or (2) open contactor (cease operation of given circuitry).

For illustrative purposes, suppose that an owner or administrator has a customer who is allowed multiple and exclusive access to a storage location for a period of 3 days, starting from Nov. 1, 2017, at 4 p.m. The storage location has a lock with serial number 12345. The owner tells the customer that after inserting the initial token, he can use a short passcode of 8899 for any subsequent entry.

The command parameters for the customer can be generated as follows:

| Command parameter | | | | | | | | | | | | | | |
|---|---|---|---|---|---|---|---|---|---|---|---|---|---|---|
| A | B | C | D | E | F | G | H | I | J | K | L | M | N | O |
| 01 | 12345 | 6 | 2 | 00 | 2 | 201711011600 | 201711041600 | 0 | 2 | 8899 | 1 | 2 | 2 | 0 |

The coding process by the code generation 110 may encrypt the command string using an appropriate decoding key or paired key for the controller 120. The encrypted string can be converted to ASCII or numeric token(s), which the owner or administrator can deliver to the customer using the appliance. For illustrative purposes, the resultant token can be visually presented and may look as follows:

4314 5434 6547 9988 6285 4837

In such example, the owner can print the token on a receipt and also send a text message with the token to the customer. At the appropriate date and time upon first entry, the customer would insert the token into the lock (that includes the controller 120 and the access unit 130) and for the next 3 days may use code 8899 to gain entry. After the checkout date, the customer will no longer be able to enter.

In another example, the owner may have a forklift (target device 140), an appliance whose ignition key (access unit 130) is equipped with the controller 120 (with a serial number 11223). The customer also wants to use the forklift (target device 140) to load and offload his goods. The owner agrees to let the customer use the forklift (target device 140) no more than 10 times, for no longer than a total of 3 hours. For the customer's convenience, the same passcode (8899) can be used on the forklift (target device 140) for subsequent uses. The owner warns the customer that after 3 hours an alarm will sound, and a few minutes later, the forklift (target device 140) will become nonoperational.

| Command parameter | | | | | | | | | | | | | | |
|---|---|---|---|---|---|---|---|---|---|---|---|---|---|---|
| A | B | C | D | E | F | G | H | I | J | K | L | M | N | O |
| 02 | 11223 | 6 | 3 | 10 | 2 | 000000000000 | 000000000000 | 3 | 2 | 8899 | 0 | 2 | 1 | 1 |

The code generation 110 would encrypt the command string, using the appropriate decoding key or paired key for the controller 120 configured to control the forklift ignition. The encrypted string would be converted to an ASCII or numeric token(s) for use by the customer for input into the controller 120 of an access unit 130 on the forklift (which includes a keypad). For illustrative purposes, the resultant token may look as follows:

3344 8266 4516 7512 7289 7319

In this example, the owner prints the token on a receipt and can also send the customer a text message containing the token. The owner suggests that the forklift (target device 140) be fitted with Bluetooth connectivity and an appropriate application be made available for download onto the customer's computing device 150, enabling the customer to insert the token into the forklift (target device 140) wirelessly. Such an application would make it easier for the customer to use other equipment (other target device or appliance 140) or extend use of the forklift (target device 140) using alternative arrangements.

The controller 120 may include a controller circuit configured to regulate the accessibility and functionality of the target device or appliance 140. Such regulation may depend on a variety of variables coded into the controller 120 for the intended functions, including serial number, group number, manufacturer key, decoding key, and decoding method.

The serial number can be a unique ID for the controller 120 coded into the controller circuit. It may be used in unison with any other manufacturer or microcontroller identity to create a unique serial number for the controller, the access unit and its appliance or target device.

The group number can represent the group of controllers 120 to which the particular controller 120 belongs, allowing management of and access to a group of controllers 120.

The manufacturer key can be a unique manufacturer key used as part of the intended encryption algorithm. Manufacturer keys may be centrally controlled to allow expanded functionality by a variety of appliance manufacturers.

The decoding key can be a secret key used to decrypt the input token for the particular controller 120, which contains functional instructions for the controller 120 and its respective target device 140.

The decoding method may be any decoding method known in the art and may include a custom or standardized and readily available library (e.g., DES, 3DES).

Instructions for the target device or appliance 140 are embedded within a numeric token. Decryption of the numeric token by the controller 120 provides offline control of a device. The controller 120, access unit 130 and target devices 140 are not required to be connected to the Internet or any other communication network. The entire control logic resides inside the controller 120, with instructions or commands delivered through the manual input of a numeric encrypted token into the keypad 130 of the controller 120.

In the present invention, the target devices 140 can thus be remotely controlled without the need for connectivity of such devices or appliances to Wi-Fi, cellular, or any other communication network.

Figure 5:
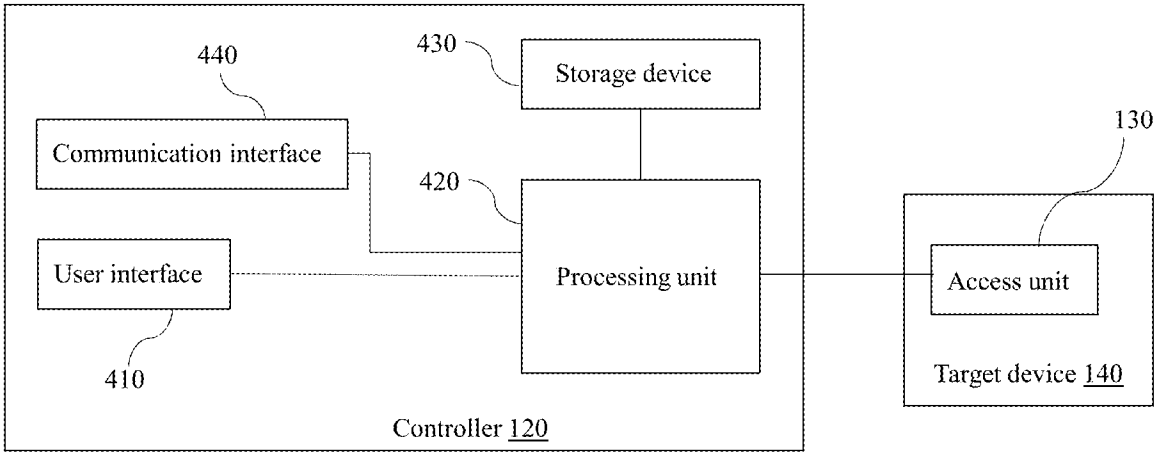
FIG. 5 is an illustration of one embodiment of a controller of the present invention.

In some embodiments, as shown in FIG. 5, the controller 120 may include a user interface 410 (e.g., keypad, display) and/or a communication interface 440 (e.g., RF, Bluetooth, Camera, Microphone) to receive input (e.g., a token) from a user and a processing unit 420. In such embodiments, the processing unit 420 may be configured to receive, via the user interface 410, a command parameter (in the form of a token) to identify the target device 140 by a serial number and an operation to be performed by a command type corresponding to the target device 140 and communicate the command type to the access unit 130 attached to the target device 140 to instruct the target device 140 to perform the operation. The user interface 410 may include input devices such as a touch pad, touch screen, buttons, keypad, keyboard, microphone, camera, scanner or the like. The user interface 410 may also include output devices such as a display screen, speakers, or the like.

Communication interface 440 can provide wireless communication capability for the controller 120. In some embodiments, the communication interface 440 can include components for accessing short range wireless communications (e.g. RF, Bluetooth, NFC, IrDA, or Wi-Fi) and/or wide area wireless technologies known in the art including cellular telephone technology (e.g. 3G, 4G/LTE, 5G) or any combination thereof and/or other components. Communication interface 440 can be implemented using a combination of hardware and software components. The hardware can include driver circuits, antennas, modulators/demodulators, encoders/decoders, and other analog and/or digital signal processing circuits.

In some embodiments, communication interface 440 can support multiple communication channels concurrently or at different times, using the same transport or different transports. The communication interface 440 may also include components necessary to communicate with a user device (which can be the computing device 150 described above) via Bluetooth, RFID, QR code, barcode, sound tone, or any other short-range communication typical to a mobile phone.

Processing unit 420 can be implemented as one or more integrated circuits (e.g., one or more single-core or multi-core microprocessors or microcontrollers). In some embodiments, processing unit 420 can execute a variety of programs in response to program code or the command parameter and can maintain multiple concurrently executing programs or processes. At any given time, some or all of the program code to be executed can be resident in the processing unit 420.

Through suitable programming, the processing unit 420 can provide various functionality for the controller 120. The processing unit 420 can also execute various programs, including application programs that may be stored in storage device 430 that may be included in the controller 120, as shown in FIG. 5.

Although the invention has been explained in relation to its preferred embodiment, it is to be understood that many other possible modifications and variations can be made without departing from the spirit and scope of the invention.

What is claimed is:

1. A method comprising:

generating, by one or more processors, at least one command parameter;

encrypting the at least one command parameter in an encrypted token;

transferring the at least one command parameter, in the encrypted token, to a computing device;

sending the at least one command parameter in the encrypted token, from the computing device, to a controller by using manual input into a keypad connected to the controller;

wherein sending the at least one command parameter to the controller further includes transferring the at least one command parameter to a customer; and controlling an access unit based on the at least one command parameter, the access unit in turn controlling an appliance.

2. The method as claimed in claim 1, further comprising: wherein the at least one command parameter includes a plurality of references to control the access unit.

3. The method as claimed in claim 1, further comprising: wherein the access unit is a lock.

4. The method as claimed in claim 1, further comprising: wherein the access unit is a switch.

5. The method as claimed in claim 1, further comprising: wherein the at least one command parameter includes a plurality of references to control the appliance.

6. The method as claimed in claim 1, further comprising: transferring the at least one command parameter to the customer by providing the at least one command parameter in the encrypted token is printed on a receipt.

7. The method as claimed in claim 1, further comprising: transferring the at least one command parameter in the encrypted token to the customer by a text type message.

8. The method as claimed in claim 1, further comprising: verbally transferring the at least one command parameter to the customer, by transferring the at least one command parameter verbally.

9. The method as claimed in claim 1, further comprising: sending to the controller the at least one command parameter by using manual input into a keypad.

10. The method as claimed in claim 1, further comprising: sending to the controller the at least one command parameter in the encrypted token by using a bar code.

11. The method as claimed in claim 1, further comprising: sending to the controller the at least one command parameter in the encrypted token by using a QR code.

12. The method as claimed in claim 1, further comprising: sending to the controller the at least one command parameter by using a sound tone.

13. The method of claim 1, further comprising:

transferring, by an administrator, the at least one command parameter, in the encrypted token, to the computing device;

sending, by the administrator, the at least one command parameter in human readable text to a user.

14. A method comprising:

generating, by one or more processors, at least one command parameter;

encrypting the at least one command parameter in an encrypted token;

transferring, by an administrator, the at least one command parameter, in the encrypted token, to a computing device;

sending the at least one command parameter in the encrypted token, from the computing device, to a controller by using manual input into a keypad connected to the controller; and controlling an access unit based on the at least one command parameter, the access unit in turn controlling an appliance a customer having the computing device; and sending the at least one command parameter in the encrypted token by the administrator to the customer having the computing device; and sending the at least one command parameter in the encrypted token to the controller by the customer having the computing device.

* * * * *